US006436211B1

(12) United States Patent
Mendenhall et al.

(10) Patent No.: US 6,436,211 B1
(45) Date of Patent: Aug. 20, 2002

(54) GAS GENERANT MANUFACTURE

(75) Inventors: Ivan V. Mendenhall, Providence; Robert G. Smith, North Ogden; Robert D. Taylor, Hyrum, all of UT (US)

(73) Assignee: Autoliv ASP, Inc., Ogden, UT (US)

( * ) Notice: Subject to any disclaimer, the term of this patent is extended or adjusted under 35 U.S.C. 154(b) by 30 days.

(21) Appl. No.: 09/618,646

(22) Filed: Jul. 18, 2000

(51) Int. Cl.[7] ..... D03D 23/00; C06B 31/28
(52) U.S. Cl. ..... 149/109.6; 149/46
(58) Field of Search ..... 149/46, 109.6

(56) References Cited

U.S. PATENT DOCUMENTS

| | | | | |
|---|---|---|---|---|
| 2,220,891 | A | | 11/1940 | Cook et al. |
| 2,904,420 | A | | 9/1959 | Holker |
| 3,002,830 | A | | 10/1961 | Barr |
| 3,067,076 | A | | 12/1962 | Butcher et al. |
| 3,144,367 | A | | 8/1964 | Enoksson |
| 4,925,600 | A | | 5/1990 | Hommel et al. |
| 5,053,086 | A | | 10/1991 | Henry et al. |
| 5,063,036 | A | | 11/1991 | Engel et al. |
| 5,071,630 | A | | 12/1991 | Oberth |
| 5,125,684 | A | | 6/1992 | Cartwright |
| 5,139,588 | A | | 8/1992 | Poole |
| 5,271,778 | A | | 12/1993 | Bradford et al. |
| 5,460,668 | A | | 10/1995 | Lyon |
| 5,472,647 | A | | 12/1995 | Blau et al. |
| 5,516,377 | A | | 5/1996 | Highsmith et al. |
| 5,518,054 | A | | 5/1996 | Mitson et al. |
| 5,529,647 | A | | 6/1996 | Taylor et al. |
| 5,531,941 | A | | 7/1996 | Poole |
| 5,542,998 | A | | 8/1996 | Bucerius et al. |
| 5,542,999 | A | | 8/1996 | Bucerius et al. |
| 5,545,272 | A | | 8/1996 | Poole et al. |
| 5,589,661 | A | | 12/1996 | Menke et al. |
| 5,592,812 | A | | 1/1997 | Hinshaw et al. |
| 5,596,168 | A | | 1/1997 | Menke et al. |
| 5,608,183 | A | | 3/1997 | Barnes et al. |
| 5,641,938 | A | | 6/1997 | Holland et al. |
| 5,663,524 | A | | 9/1997 | Bucerius et al. |
| 5,677,510 | A | | 10/1997 | Bucerius et al. |
| 5,682,014 | A | | 10/1997 | Highsmith et al. |
| 5,725,699 | A | | 3/1998 | Hinshaw et al. |
| 5,726,382 | A | | 3/1998 | Scheffee et al. |
| 5,735,118 | A | | 4/1998 | Hinshaw et al. |
| 5,747,730 | A | | 5/1998 | Scheffee et al. |
| 5,780,768 | A | | 7/1998 | Knowlton et al. |
| 5,783,773 | A | | 7/1998 | Poole |
| 5,847,315 | A | | 12/1998 | Katzakian, Jr. et al. |
| 5,850,053 | A | | 12/1998 | Scheffee et al. |
| 5,866,842 | A | | 2/1999 | Wilson et al. |
| 6,103,030 | A | * | 8/2000 | Taylor et al. ..... 149/46 |
| 6,132,538 | A | * | 10/2000 | Mendenhall et al. ..... 149/46 |
| 6,165,296 | A | * | 12/2000 | Mendenhall et al. ..... 149/61 |
| 6,224,697 | B1 | * | 5/2001 | Mendenhall et al. .... 149/109.6 |

FOREIGN PATENT DOCUMENTS

| | | |
|---|---|---|
| DE | 44 42 169 C1 | 12/1995 |

* cited by examiner

*Primary Examiner*—Charles T. Jordan
*Assistant Examiner*—Aileen J. Baker
(74) *Attorney, Agent, or Firm*—Sally J. Brown; James D. Erickson

(57) ABSTRACT

A method of making a gas generant formulation which contains a transition metal diammine dinitrate is provided wherein a transition metal ammine carbonate is reacted with nitric acid in the presence of water to form a corresponding reaction mixture. A spray dryable precursor to the gas generant formulation is formed including at least a gas generating fuel and a sufficient quantity of water to render the precursor spray dryable. The precursor is subsequently spray dried to form a gas generant powder. The method may also include a relatively mild heat treatment of the dried material, either as a part of the spray drying or subsequent to such spray drying. A phase stabilized ammonium nitrate and a corresponding method of making the same wherein ammonium nitrate is stabilized through the presence of a stabilizing metal diammine dinitrate are also provided.

32 Claims, No Drawings

GAS GENERANT MANUFACTURE

CROSS REFERENCE TO RELATED APPLICATIONS

The subject matter of this application is related to prior U.S. patent applications Ser. Nos. 09/454,041 and 09/454,958, each filed on Dec. 03, 1999. The disclosures of these related patent applications are each hereby incorporated by reference herein and made a part hereof, including but not limited to those portions which specifically appear hereinafter.

BACKGROUND OF THE INVENTION

This invention relates generally to gas generant materials. More particularly, this invention relates to the manufacture of gas generant formulations such as may be suited for use in the inflation of automotive inflatable restraint airbag to cushions.

It is well known to protect a vehicle occupant using a cushion or bag, e.g., an "airbag cushion," that is inflated or expanded with gas when the vehicle encounters sudden deceleration, such as in the event of a collision. In such systems, the airbag cushion is normally housed in an uninflated and folded condition to minimize space requirements. Upon actuation of the system, the cushion begins to be inflated, in a matter of no more than a few milliseconds, with gas produced or supplied by a device commonly referred to as an "inflator."

While many types of inflator devices have been disclosed in the art for use in the inflating of one or more inflatable restraint system airbag cushions, inflator devices which rely on the combustion of a pyrotechnic, fuel and oxidizer combination or other form of gas generant to produce or at least in part form the inflation gas issuing forth therefrom have been commonly employed in conjunction with vehicular inflatable restraint airbag cushions.

Sodium azide has been a commonly accepted and used gas generating material. While the use of sodium azide and certain other azide-based gas generant materials meets current industry specifications, guidelines and standards, such use may involve or raise potential concerns such as involving one or more of the handling, supply and disposal of such materials.

The development of safe gas generant material alternatives to sodium azide for commercial application in inflatable restraint systems commonly involves the oftentimes conflicting goals or objectives of increasing the gas output of the gas generant material while reducing or minimizing the costs associated with the gas generant material, including the costs associated with ingredients and the processing thereof.

The incorporation and use of ammonium nitrate as an oxidizer in such gas generant formulations has been found to be one generally cost-effective approach for exceeding the current state of the art gas generant formulation gas yield of about three moles of gas per 100 grams of gas generant formulation. In particular, ammonium nitrate is relatively inexpensive and, when burned with guanidine nitrate fuel, generally combusts to all gaseous species resulting in gas yields approaching 4 moles of gas per 100 grams of material.

Unfortunately, the general incorporation and use of ammonium nitrate in pyrotechnic gas generant formulations has generally been subject to certain difficulties. For example, ammonium nitrate-containing pyrotechnic gas generant formulations have commonly been subject to one or more of the following shortcomings: low burn rates, burn rates exhibiting a high sensitivity to pressure, as well as to phase or other changes in crystalline structure such as may be associated with volumetric expansion of various forms of such formulations, such as may occur during temperature cycling over the normally expected or anticipated range of storage conditions, e.g., temperatures of about −40° C. to about 110° C. Such phase or structural changes may result in physical degradation of the form of the gas generant formulation such as when such gas generant formulation has been shaped or formed into tablets, wafers or other selected shape or form. Further, such changes, even when relatively minute, can strongly influence the physical properties of a corresponding gas generant material and, in turn, strongly affect the burn rate of the generant material. Unless checked, such changes in structure may result in such performance variations in the gas generant materials incorporating such ammonium nitrate as to render the gas generant material unacceptable for typical inflatable restraint system applications.

In view thereof, efforts have been directed to minimizing or eliminating such volume expansion during normal temperature cycling and the effects thereof. In particular, it has been found that the incorporation of a minimum of about 15 wt. % (based on total oxidizer content) of a transition metal diammine dinitrate such as copper diammine dinitrate, nickel diammine dinitrate or zinc diammine dinitrate, for example, in ammonium nitrate, may serve to phase stabilize the mixture and minimize or eliminate volumetric expansion during normal temperature cycling associated with such inflatable restraint applications. Further, ammonium nitrate stabilized with such transition metal diammine dinitrates are typically advantageously less hygroscopic than ammonium nitrate phase stabilized by other methods and the use of such transition metal diammine dinitrates has also been found to result in combustion products which form a more easily filterable clinker.

Ammonium nitrate phase stabilization via the incorporation of such transition metal diammine dinitrates, however, is typically at the cost of an associated reduction in gas yield. For example, the gas yield of a typical formulation containing guanidine nitrate, silicon dioxide (5 wt. %) and ammonium nitrate stabilized with 15 wt. % (based on total oxidizer) of such transition metal diammine dinitrate is about 3.8 moles of gas per 100 grams of gas generant material.

The gas generant formulation incorporation of such transition metal diammine dinitrates at levels greater than 15 wt. % (of the total oxidizer) has been found to increase burn rate and reduce pressure sensitivity of a corresponding gas generant formulation to levels realistic for typical inflatable restraint system applications. The maximum effect on burn rate has been found to generally occur when 100% of the oxidizer is composed of the transition metal diammine dinitrate. The gas yield of a typical formulation containing guanidine nitrate, silicon dioxide (5 wt. %) and such transition metal diammine dinitrate as 100% of the oxidizer is about 3.3 moles of gas per 100 grams of gas generant material, well above the current state of the art gas generant formulation gas yield of about 3 moles of gas per 100 grams of gas generant formulation.

A traditional method of incorporating such a transition metal diammine dinitrate into ammonium nitrate is to react the corresponding metal oxide with ammonium nitrate. For example, for the incorporation of copper diammine dinitrate, cupric oxide and ammonium nitrate can be reacted according to the following reaction:

$$CuO+2NH_4NO_3 \rightarrow Cu(NH_3)_2(NO_3)_2+H_2O \quad (1)$$

This reaction occurs at elevated temperatures (e.g., in excess of 140° C.) in either a solid state reaction or in an ammonium nitrate melt. The rate of such a solid state reaction is temperature dependent and under normal processing conditions (a processing temperature of about 170° C.), such reaction typically requires, dependent on the rate of heat transfer achieved, about 30 minutes to 2 hours to complete. As will be appreciated, such extended processing times typically can render such processing regimes commercially unattractive or not feasible. Further, the conducting of such reaction in an ammonium nitrate melt generally requires specialized equipment since the material would normally have to be melted, reacted, and cooled, returning to a solid form, while simultaneously being granulated. In the case of either such solid state or melt processing regimes, the temperature required to perform such reactions is only about 20° C. to about 30° C. below the temperature at which such corresponding pyrotechnic formulations may begin to decompose. Thus, such processing may not afford a thermal safety margin as sufficiently large as may be desired, particularly for large scale applications. Further, such high temperature heat treatments can constitute an added processing step that may detrimentally affect process economics.

Thus, there has been a need and a demand for a method of making a gas generant formulation which contains a transition metal diammine dinitrate which desirably avoids such high temperature processing. In particular, there has been a need and a demand for a method of making such a gas generant formulation and which can desirably be implemented within typical or existing processing equipment and such as may be accomplished over a relatively short time period, such as may be desired in a typical commercial application.

To that end, the above-identified prior U.S. patent application Ser. No. 09/454,041 discloses an improved method of making a gas generant formulation which contains a transition metal diammine dinitrate. In accordance with one preferred embodiment disclosed therein, such a method includes the steps of:

combining at least a nitrate of at least one transition metal with an ammonia source in an aqueous slurry to form a corresponding reaction mixture;

forming a spray dryable precursor to the gas generant formulation, the precursor comprising the aqueous slurry reaction mixture, a gas generant formulation fuel component and a sufficient quantity of water to render the precursor spray dryable; and spray drying the precursor to form a gas generant powder containing a diammine dinitrate of the at least one transition metal.

In particular, an appropriate metal nitrate (such as cupric nitrate) can be reacted with an appropriate ammonia source (such as ammonium bicarbonate, ammonium carbonate or ammonium carbamate) in a concentrated water solution to form a desired metal diammine dinitrate.

In addition, there is a need and a demand for a method of making ammonium nitrate phase stabilized via the presence of a selected metal diammine dinitrate and which method avoids undesirably high processing temperatures, i.e., processing temperatures which are undesirably near the decomposition temperature of ammonium nitrate, and which avoids isolation of metal tetrammine nitrate complexes such as may raise shipping and handling concerns.

To that end, the above-identified prior U.S. patent application Ser. No. 09/454,958 discloses a method of making phase stabilized ammonium nitrate which includes drying and heat treating an aqueous slurry containing ammonium nitrate and a combination of at least one transition metal nitrate and an ammonia source to form a phase stabilized ammonium nitrate. In the slurry, the ammonia source is present in at least a stoichiometric amount relative to the at least one transition metal nitrate for formation of a corresponding transition metal diammine dinitrate.

While such methods of making a gas generant formulation which contains a transition metal diammine dinitrate and such methods of making phase stabilized ammonium nitrate may desirably reduce the equipment and processing costs associated with the production and supply of the respective gas generant formulations and phase stabilized ammonium nitrate, there is a continuing need and demand for alternative processing schemes for the production and supply of gas generant formulations which contain such transition metal diammine dinitrate and for ammonium nitrate phase stabilized via the inclusion of a suitable phase stabilizing amount or proportion of a desired metal diammine dinitrate. In particular, there is a need and a demand for alternative such processing schemes such as may permit the use of alternative, potentially lower cost, raw materials, preferably without significantly detrimentally impacting the processing costs associated therewith.

SUMMARY OF THE INVENTION

A general object of one aspect of the invention is to provide an improved method of making a gas generant formulation which contains a transition metal diammine dinitrate.

A general object of another aspect of the invention is to provide an improved method of making phase stabilized ammonium nitrate as well as an improved resulting phase stabilized ammonium nitrate.

A more specific objective of the invention is to overcome one or more of the problems described above.

The general object of at least one aspect of the invention can be attained, at least in part, through a method which includes the steps of:

combining at least an ammine carbonate of at least one transition metal with nitric acid in the presence of water to form a corresponding reaction mixture;

forming a spray dryable precursor to the gas generant formulation, the precursor comprising the reaction mixture, a gas generant formulation fuel component and a sufficient quantity of water to render the precursor spray dryable; and spray drying the precursor to form a gas generant powder containing a diammine dinitrate of the at least one transition metal.

As detailed below, certain preferred embodiments of the invention may also include a relatively mild heat treatment of the processed material, either as a part of the spray drying or subsequent to such spray drying.

The prior art generally fails to provide a method of making a gas generant formulation which contains a transition metal diammine dinitrate which method while desirably avoiding high temperature processing such as processing at temperatures undesirably near the decomposition temperature of corresponding pyrotechnic formulations and which method can desirably be implemented within typical or existing processing equipment and/or within relatively short processing time periods further utilizes or permits the use of alternative raw materials such as may reduce either or both material or processing costs.

The invention further comprehends a method of making a gas generant formulation which contains a gas generant fuel component and an oxidizer component comprising at least one transition metal diammine dinitrate selected from the group consisting of copper diammine dinitrate, zinc diammine dinitrate and combinations thereof. In accordance with one preferred embodiment, such method includes the steps of:

combining an ammine carbonate of at least one transition metal elected from the group consisting of copper, zinc and mixtures thereof with nitric acid in the presence of water and in relative amounts to form a corresponding reaction mixture containing nitric acid in no more than a stoichiometric amount for reaction of the ammine carbonate and the nitric acid to form a corresponding diammine dinitrate;

forming a precursor to a spray dryable gas generant formulation, the precursor comprising the aqueous reaction mixture, additional gas generant formulation components including at least one gas generating fuel material and at least one performance additive selected from the group of aluminum oxide, silicon dioxide and combinations thereof, and a sufficient quantity of water to form a spray dryable gas generant formulation precursor slurry; and spray drying the gas generant formulation precursor slurry to form a gas generant powder; and heating the gas generant powder to a temperature in the range of about 125° C. to about 135° C. to form a gas generant formulation which contains a gas generant fuel component and an oxidizer component comprising a diammine dinitrate of the at least one transition metal.

In accordance with still another embodiment of the invention, a method of making a gas generant formulation which contains a gas generant fuel component and an oxidizer component including at least one transition metal diammine dinitrate selected from the group of copper diammine dinitrate, zinc diammine dinitrate and combinations thereof is provided. Such method includes the step of combining a quantity of at least one ammine carbonate of a transition metal elected from the group consisting of copper, zinc and mixtures thereof with a quantity of nitric acid in the presence of water to form a corresponding reaction mixture. In such reaction mixture, the quantity of the transition metal ammine carbonate and the quantity of nitric acid are in relative amounts sufficient such that the reaction mixture contains no free nitric acid after reaction of the at least one ammine carbonate with the nitric acid.

A precursor to a spray dryable gas generant formulation is formed. The precursor includes the reaction mixture, additional gas generant formulation components including at least one gas generating fuel material and at least one performance additive, and a sufficient quantity of water to form a spray dryable gas generant formulation precursor slurry. In particular, the at least one gas generating fuel material can desirably be selected from the group consisting of oxygenated nitrogen-containing organic compounds, organic compounds with a high nitrogen content, complexes of at least one transition metal and combinations thereof. The at least one gas generating fuel is included in the precursor in an amount sufficient that about 20 wt. % to about 70 wt. % of the gas generant formulation constitutes such fuel material. The at least one performance additive is preferably selected from the group of aluminum oxide, silicon dioxide and combinations thereof. More particularly, the precursor contains between about 30 wt. % to about 35 wt. % water.

The gas generant formulation precursor slurry is subsequently spray dried to form a gas generant powder. The gas generant powder in turn is heated to a temperature in the range of about 125° C. to about 135° C. to form a heat treated gas generant powder which contains about 30 wt. % to about 60 wt. % of an oxidizer component, wherein the transition metal diammine dinitrate constitutes about 15 wt. % to about 100 wt. % of the oxidizer component.

Another aspect of the invention relates to a method of making a phase stabilized ammonium nitrate. In accordance with one embodiment of the invention, such method includes drying and heat treating an aqueous slurry containing ammonium nitrate and a combination of at least one transition metal ammine carbonate and nitric acid to form a phase stabilized ammonium nitrate. In the slurry, the nitric acid is present in more than a stoichiometric amount relative to the at least one transition metal ammine carbonate for formation of the a corresponding transition metal diammine dinitrate.

The invention, in accordance with another alternative preferred embodiment of the invention, still further comprehends a phase stabilized ammonium nitrate. In particular, such phase stabilized ammonium nitrate is desirably made by drying and heat treating an aqueous slurry containing ammonium nitrate and a combination of at least one transition metal ammine carbonate and nitric acid, present in no more than a stoichiometric amount relative to the at least one transition metal ammine carbonate for formation of a corresponding transition metal diammine dinitrate.

Other objects and advantages will be apparent to those skilled in the art from the following detailed description taken in conjunction with the appended claims.

DETAILED DESCRIPTION OF THE INVENTION

The present invention provides an improved method of making a gas generant formulation. In particular, the invention provides an improved method of making a gas generant material which contains a transition metal diammine dinitrate and which such gas generant material may desirably be used in the inflation of inflatable devices such as vehicle occupant restraint airbag cushions.

Gas generant materials and formulations prepared in accordance with the invention typically include an oxidizer component including, at least in part, a transition metal diammine nitrate oxidizer material, a gas generating fuel component and, if desired, at least one performance additive such as in the form of a metal oxide such as added to improve either or both slag formation or burn rate properties or qualitites. For example, such improved slag formation can be useful in either or both facilitating retention within an inflator device of certain combustion reaction products whose presence in airbag cushion inflation fluids is generally undesired and providing or resulting in a generally more uniform flow of inflation fluid from such an inflator device. Burn rate property or quality improvements realizable through such additive inclusion include such resulting gas generant materials or formulations exhibiting improved or increased burn rates.

In accordance with certain preferred embodiments of the invention, between about 30 wt. % and about 60 wt. % of the subject gas generant material constitutes such an oxidizer component. In particular, gas generant materials and formulations in accordance with the invention advantageously contain an oxidizer component of which at least 15 wt. % up to about 100 wt. % is composed of a transition metal diammine nitrate oxidizer material, prepared as described herein. Preferred transition metal diammine nitrate oxidizer materials for use in the practice of the invention include copper diammine dinitrate, zinc diammine dinitrate and combinations thereof. If desired, the balance of the oxidizer component of the subject gas generant materials may constitute a suitable supplemental oxidizer material, such as ammonium nitrate in accordance with one preferred embodiment of the invention.

In accordance with a preferred practice of the invention, such transition metal diammine nitrate oxidizer materials are preferably formed during processing in a manner such as avoids or eliminates the need for subsequent high temperature treatment undesirably near the decomposition temperature associated with the such corresponding pyrotechnic formulations. Further, practice of the invention desirably avoids extended durations of heating, such as may be associated with at least certain prior art techniques.

As disclosed in the prior pending patent application Ser. No. 09/454,041 identified above, such transition metal diammine dinitrates, such as where the transition metal is selected from the group consisting of copper, nickel, zinc and combinations thereof, have been found to be advantageously formed during a process in which the corresponding transition metal nitrate is combined with an ammonia source in an aqueous slurry such as to form a reaction mixture and which reaction mixture is processed as described herein.

In particular, the metal nitrate can desirably be combined with a stoichiometric amount or more of ammonia from one or more of the following sources: ammonium bicarbonate, ammonium carbonate, ammonium carbamate, ammonium hydroxide, anhydrous ammonia or mixtures thereof, relative to the corresponding metal diammine dinitrate such as in accordance with the following reactions relative to the formation of copper diammine dinitrate:

a) via ammonium bicarbonate, $$Cu(NO_3)_2 \cdot 2.5H_2O + 2NH_4HCO_3 \rightarrow Cu(NH_3)_2(NO_3)_2 + 2CO_2 + 4.5H_2O \quad (2)$$

b) via ammonium carbonate, $$Cu(NO_3)_2 \cdot 2.5H_2O + (NH_4)_2CO_3 \rightarrow Cu(NH_3)_2(NO_3)_2 + CO_2 + 3.5H_2O \quad (3)$$

c) via ammonium carbamate, $$Cu(NO_3)_2 \cdot 2.5H_2O + NH_2CO_2NH_4 \rightarrow Cu(NH_3)_2(NO_3)_2 + CO_2 + 2.5H_2O \quad (4)$$

d) via ammonium hydroxide, $$Cu(NO_3)_2 \cdot 2.5H_2O + 2NH_4OH \rightarrow Cu(NH_3)_2(NO_3)_2 + 4.5H_2O \quad (5)$$

e) via anhydrous ammonia, $$Cu(NO_3)_2 \cdot 2.5H_2O + 2NH_3 \rightarrow Cu(NH_3)_2(NO_3)_2 + 2.5H_2O \quad (6)$$

In accordance with a particularly preferred practice of such embodiment, such reaction mixtures desirably provide or result in at least two moles of ammonia per mole of metal provided by the metal nitrate. Further, while the reactions (2)–(6) have been shown above employing cupric nitrate in the 2.5-hydrate form, the broader practice of the invention is not necessarily limited by the particular hydrate form of the ingredients. For example, similar reactions can be shown employing cupric nitrate trihydrate.

Now, in a new embodiment, such metal diammine dinitrates, such as where the metal is a transition metal selected from the group consisting of copper, zinc and combinations thereof, have been found to be advantageously formed during a process in which the corresponding transition metal ammine carbonate is combined with nitric acid in the presence of water to form a corresponding reaction mixture and which reaction mixture is subsequently processed as described herein.

In particular, the metal ammine carbonate can desirably be combined with a stoichiometric amount or more of nitric acid, relative to the corresponding metal diammine dinitrate such as in accordance with the following reactions relative to the formation of copper diammine dinitrate:

$$Cu(NH_3)_2CO_3 + 2HNO_3 \rightarrow Cu(NH_3)_2(NO_3)_2 + CO_2 + H_2O \quad (7)$$

In accordance with a particularly preferred practice of such embodiment, such reaction mixtures desirably provide or result in at least two moles of nitrate per mole of metal provided by the metal ammine carbonate.

As will be appreciated, copper diammine carbonate (CDC) can be relatively easily prepared by dissolving copper metal in ammonium hydroxide and bubbling carbon dioxide through the resulting mixture. The CDC precipitates from the mixture and can be isolated and purified. Further, nitric acid is a relatively low cost chemical, readily available on the open market. Thus, at current chemical costs, the raw material costs for copper diammine dinitrate production via such a CDC/nitric acid method is about 20% less than the raw material costs associated with copper diammine dinitrate production via the cupric nitrate/ammonium carbonate method described above, with the labor and equipment costs for both methods being about the same.

In accordance with certain preferred embodiments of the invention, between about 20 wt. % and about 70 wt. % of the subject gas generant material constitutes such a gas generating fuel component. Preferred fuel materials for use in the practice of the invention are non-azide in nature. Groups or categories of fuels useful in the practice of the invention include one or more various oxygenated nitrogen-containing organic compounds, one or more organic compounds with a high nitrogen content, and one or more complexes of at least one transition metal. Specific examples of oxygenated nitrogen-containing organic compounds useful in the practice of the invention include guanidine nitrate, aminoguanidine nitrate, triaminoguanidine nitrate, nitroguanidine, nitrotriazalone and mixtures thereof. Specific examples of organic compounds with a high nitrogen content useful in the practice of the invention include dicyandiamide, triazalone, tetrazoles, triazoles and mixtures thereof. Specific examples of transition metal complexes useful in the practice of the invention include transition metal complexes of tetrazoles and triazoles, transition metal nitrate complexes of nitrogen containing organic compounds and mixtures thereof. In particular, such complexes of transition metals such as copper, cobalt, and zinc, for example, can be used. As will be appreciated, the gas generating fuel component of particular gas generant compositions in accordance with the invention may be comprised of individual such fuel materials or combinations thereof.

Gas generant materials or formulations prepared in accordance with the invention may additionally desirably contain one or more performance additives such as in the form of a metal oxide such as added to improve either or both slag formation or burn rate properties or qualitites. Particular examples of suitable such performance additives are aluminum oxide and silicon dioxide. In practice, such additives may desirably be included in relative amounts of between about 2 wt. % and about 10 wt. % of the gas generant formulation. The incorporation and use of such silicon and aluminum oxide materials are particularly effective in facilitating the production of a slag material which is relatively easily filtered from the gas stream of an airbag inflator.

In accordance with the invention, such gas generant formulations can desirably be made via a method which includes combining a transition metal nitrate with an ammonia source in an aqueous slurry or, alternatively, combining a transition metal ammine carbonate with nitric acid in the presence of water, such as to form a corresponding reaction mixture, such as described above, and forming a spray dryable precursor to the gas generant formulation, the precursor including the reaction mixture, desired additional gas generant formulation components including at least a gas generating fuel and a sufficient quantity of water to render the precursor spray dryable. While the broader practice of the invention is not limited by the specific amount of water added during such processing, it has been found generally desirable that water be added in sufficient quantity that the spray dryable gas generant formulation precursor slurry contains between about 30 wt. % and about 35 wt. % water.

It will be appreciated that various processing arrangements are available whereby such a spray dryable precursor can be formed or arrived at. For example, in accordance with one embodiment of the invention, such spray dryable precursor is formed via the above-identified aqueous slurry reaction mixture being prepared such as to contain the desired quantity of water to render the precursor spray dryable.

Alternatively, an additional quantity of water may be required to be added to the aqueous slurry reaction mixture to render a spray dryable precursor.

In accordance with one preferred practice of the invention, it is generally desirable that additional gas generant formulation components such as either or both a gas generating fuel material and, if used, a performance additive, such as described above, be added to the above-identified aqueous slurry reaction mixture, such as after completion of reaction of the combined transition metal ammine carbonate and nitric acid, such as evidenced by the completion of the evolution of carbon dioxide therefrom. Such post-reaction addition is generally preferred as the possibility of undesired reaction between one or more of such additional gas generant formulation components, either alone or in combination with either or both the transition metal ammine carbonate and nitric acid can accordingly be avoided or limited.

The spray dryable precursor can then be appropriately spray dried, in a manner such as is known in the art and so as to form a gas generant powder containing a diammine dinitrate of the at least one transition metal.

Following such spray drying and as detailed below in the examples, a relatively minor or mild heat treatment (i.e., heating of the material to a temperature of no more than about 135° C., e.g., a temperature of approximately 125–130° C. and holding the heated material at that temperature for a duration of at least approximately 5 minutes) of the material resulting upon such spray drying, may be desired or required in order to ensure or complete conversion of the transition metal species to the desired transition metal diammine dinitrate and such has been found to remain in a stable form.

The application of more severe heat treatment processing (i.e., processing involving either or both heating the material to a higher temperature, such as a temperature in excess of or greater than 135° C., or for significantly longer periods of time, such as for durations of 10 minutes or more) is generally not preferred or desired. In particular, such more severe heat treatment processing generally has associated therewith correspondingly higher processing costs without necessarily providing or resulting in concomitant processing or product benefits or improvements.

Those skilled in the art and guided by the teachings herein provided will appreciate that post-spray dry heating can desirably be avoided where, for example, sufficient heat treatment is achieved or realized during the drying process. Alternatively, however, such heating can be relatively easily implemented into a processing scheme such as via in-line fluid bed dryers such as may be incorporated between a spray-dry tower and an associated collection bin, for example. In either case, such heat treatment is generally either or both at significantly lower processing temperatures or for significantly shorter durations than associated with prior art processing techniques.

The resulting gas generant powder can be appropriately processed or shaped, such as by being tableted or wafered, for example and is generally known in the art, and such as may be desired for particular applications of such a gas generant formulation.

While the invention has been described above with reference to the making or processing of gas generant formulations which contain a transition metal diammine dinitrate, it will be appreciated that the invention can, if desired, be applied to the making or processing of phase stabilized ammonium nitrate. In particular, the invention can be applied to provide a method of making a phase stabilized ammonium nitrate such as may desirably be used in gas generant formulations such as used in the inflation of inflatable devices such as vehicle occupant restraint airbag cushions.

In accordance with this aspect of the invention, a metal ammine carbonate, particularly a transition metal ammine carbonate, such as described above, is combined with nitric acid, the nitric acid present in no more than a stoichiometric amount relative to the at least one transition metal ammine carbonate for formation of the a corresponding transition metal diammine dinitrate, to form a first precursor.

In accordance with one preferred embodiment of the invention, a second precursor to the phase stabilized ammonium nitrate is formed to contain the first precursor and ammonium nitrate. As further detailed below, such second precursor desirably is in the form of a slurry, e.g., an aqueous slurry. As will be appreciated by those skilled in the art and guided by the teachings herein provided, such precursor can be arrived at by various techniques or specific processing steps without deviating from the general principles and guidelines herein provided. For example, in accordance with one embodiment of the invention, the ammonium nitrate in the "second precursor" or a desired portion thereof may be added to the first precursor material, prepared as described above. In accordance with an alternative preferred embodiment of the invention, the ammonium nitrate or a desired portion thereof may simply be added to or included in the aqueous slurry from which the first precursor, as described above, is formed or produced. In particular, the presence of ammonium nitrate in such slurry mix is believed to advantageously serve to stabilize such metal diammine dinitrate or various related forms such as may be formed therein from subsequent, undesired reactions, for example, from subsequent hydrolysis reaction.

This precursor slurry is, in turn, dried and heated to form a phase stabilized ammonium nitrate. In particular, such phase stabilized ammonium nitrate desirably contains a phase stabilizing quantity or relative proportion of the diammine dinitrate of the transition metal of the nitrate used above. In practice, the relative proportion of such transition metal diammine dinitrate required to be present in ammonium nitrate to effect desired phase stabilization will typically vary dependent on the particular application and conditions of operation. In general, however, such phase stabilizing quantity or proportion of transition metal diammine dinitrate typically constitutes the transition metal diammine dinitrate being present in the ammonium nitrate in a relative amount of at least about 1 wt. %, preferably at least about 10 wt. % and, most preferably, at least about 15 wt. %. For example, in typical vehicle occupant inflatable restraint system applications, the inclusion of at least about 15 wt. % of such transition metal diammine dinitrate in ammonium nitrate is generally desired to achieve a desired level of ammonium nitrate phase stabilization such as may avoid unacceptable performance variations in corresponding gas generant materials as such as would otherwise render such gas generant materials unacceptable for typical inflatable restraint system applications.

In particular, such drying treatment can be variously accomplished, as those skilled in the art and guided by the teachings herein provided will appreciate. For example, tray drying such as involving the use of a vacuum or convection oven, for example, can be used. In a preferred embodiment of the invention, such precursor slurry is desirably spray dried such as to form a precursor to the phase stabilized ammonium nitrate and which precursor desirably has the form of a powder. As will be appreciated, spray drying may advantageously provide or result in high processing throughputs while avoiding subjecting the treated materials to elevated temperatures for prolonged periods of time.

Following such spray drying and as described above, a relatively minor or mild heat treatment (i.e., heating of the material to a temperature of no more than about 135° C., e.g., a temperature of approximately 125–130° C. and holding the heated material at that temperature for a duration of at least approximately 5 minutes) of the material resulting upon such spray drying, may be desired or required in order to ensure or complete conversion of the transition metal species to the desired transition metal diammine dinitrate and such has been found to remain in a stable form. As will be appreciated, such subsequent heat treatment can desirably be accomplished in a solid state, thus desirably simplifying processing and handling, for example.

In accordance with one preferred embodiment of the invention, such drying and heating can desirably be conducted or accomplished in a single processing step such as where sufficient heat treating of the processed material is accomplished during the drying process. In an alternative preferred embodiment of the invention, such drying and heating are conducted or accomplished in separate processing steps, such as may be conducted in sequence. In accordance with one such alternative embodiment, such relatively minor or mild heat treatment can be relatively easily implemented into a processing scheme such as via in-line fluid bed dryers such as may be incorporated between a spray-dry tower and an associated collection bin, for example. In either case, such heat treatment is generally either or both at significantly lower processing temperatures or for significantly shorter durations than associated with prior art processing techniques.

The application of more severe heat treatment processing (i.e., processing involving either or both heating the material to a higher temperature, such as a temperature in excess of or greater than 135° C., or for significantly longer periods of time, such as for durations of 10 minutes or more) is generally not preferred or desired. In particular, such more severe heat treatment processing generally has associated therewith correspondingly higher processing costs without necessarily providing or resulting in concomitant processing or product benefits or improvements.

Those skilled in the art and guided by the teachings herein provided will appreciate that post-spray dry heating can desirably be avoided where, for example, sufficient heat treatment is achieved or realized during the drying process. Alternatively, however, such heating can be relatively easily implemented into a processing scheme such as via in-line fluid bed dryers such as may be incorporated between a spray-dry tower and an associated collection bin, as described above.

In accordance with a preferred practice of the invention, the resulting phase stabilized ammonium nitrate powder desirably contains a phase stabilizing quantity or proportion of the diammine dinitrate of the associated transition metal, as detailed above.

As will be appreciated, such phase stabilized ammonium nitrate can find various applications. For example, such phase stabilized ammonium nitrate can find application in various gas generant formulations such as used in association with inflatable restraint systems and such as otherwise known in the art. In particular, such phase stabilized ammonium nitrate can be easily implemented into various gas generant formulations such as those prepared or produced via extrusion or granulation, for example.

Such a processing method allows for preparation of metal diammine dinitrate phase stabilized ammonium nitrate without isolation of explosive metal tetrammine nitrate complexes. Further, the final relatively mild heat treatment, such as may be desired to ensure complete formation of metal diammine dinitrate, can desirably be done or preformed in a solid state, not in a melt. Thus, facilitating and permitting the preparation of phase stabilized ammonium nitrate, in accordance with the invention, via the use or processing of existing spray dry/fluid bed dryer equipment.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Example 1

A laboratory scale batch of gas generant was prepared by the CDC/nitric acid method using the following procedure: 27.9 ml of nitric acid were diluted in 30 ml of water. CDC powder was slowly added to water nitric acid solution. Carbon dioxide gas evolved and the slurry turned a blue color. Then, 42.95 grams of guanidine nitrate and 5.10 grams of silicon dioxide were stirred into the mixture. The final moisture content of the aqueous slurry was approximately 32%. At this point the mix would be spray dryable; however, in the lab the mixture was vacuum dried at a temperature of 80° C. until dry. In the dried formulation, the CDDN appeared to disproportionate into copper tetrammine dinitrate (CTDN) and another blue species. Raising the temperature of the powder to 140° C. converted the mixture of copper species to CDDN which remained stable even under aging conditions (107° C.). The spray-dry process itself is sufficient to heat the material to the required temperature for CDDN formation as demonstrated with the cupric nitrate/ammonium carbonate method. The laboratory mix was thoroughly analyzed and compared to a laboratory mix prepared via the cupric nitrate/ammonium carbonate method and a spray dry/heat treated mix prepared via the cupric oxide/ammonium nitrate method. The results are shown in TABLE 1, below.

TABLE 1

| | $CDC/HNO_3$ Method (wt. %) | $CuO/NH_4NO_3$ Method (wt. %) | $Cu(NO_3)_2/(NH_4)_2CO_3$ Method (wt. %) |
|---|---|---|---|
| ANALYSIS | | | |
| guanidine nitrate | 42.50 | 40.20 | 42.10 |
| $NH_3$ | 6.56 | 7.76 | 7.23 |
| total copper | 15.49 | 14.13 | 14.62 |
| carbon | 4.39 | 4.21 | 4.25 |
| BURN RATE | | | |
| inch per sec. (@1000 psi) | 0.50 | 0.59 | 0.41 |
| slope | 0.42 | 0.53 | 0.56 |
| constant | 0.028 | 0.015 | 0.008 |

The analysis data showed similar results for all mixes. The amount of carbon in each mix is due to the guanidine nitrate carbon. Any excess carbon would indicate incomplete reaction of the CDC with nitric acid. Aging of the gas generant produced by the $CDC/HNO_3$ method showed no loss in weight or burn rate after 400 hours at 107° C. The proposed method will allow us to reduce the cost of raw materials required to make CDDN-based gas generants. The new process also allows us to continue to enjoy increased safety of the process due to elimination of the heat treatment step.

Thus, the invention provides a method of making a gas generant formulation which contains a transition metal diammine dinitrate which method can desirably be implemented within typical or existing processing equipment and which method desirably avoids high temperature processing such as processing at temperatures undesirably near the decomposition temperature of corresponding pyrotechnic formulations. Further, the invention provides a method of making such a gas generant formulation such as desirably may be accomplished over a relatively short time period, such as may be desired in various commercial applications. Still further, the invention provides methods of making such gas generant formulations which desirably utilize or permit the use or relatively low cost chemical ingredients such as to improve processing economics and the commercial practicality thereof The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A method of making a gas generant formulation which contains a transition metal diammine dinitrate, the method comprising the steps of:

combining at least an ammine carbonate of at least one transition metal with nitric acid in the presence of water to form a corresponding reaction mixture;

forming a spray dryable precursor to the gas generant formulation, the precursor comprising the reaction mixture, a gas generant formulation fuel component and a sufficient quantity of water to render the precursor spray dryable; and spray drying the precursor to form a gas generant powder containing a diammine dinitrate of the at least one transition metal.

2. The method of claim 1 additionally comprising the step of:

heat treating the gas generant powder.

3. The method of claim 2 wherein the heat treating step comprises heating the gas generant powder to a temperature no more than about 135° C.

4. The method of claim 1 wherein:

the transition metal of the transition metal ammine carbonate is selected from the group consisting of copper, zinc and combinations thereof.

5. The method of claim 4 wherein transition metal ammine carbonate comprises copper diammine carbonate.

6. The method of claim 1 wherein the gas generating fuel component comprises an oxygenated nitrogen-containing organic compound.

7. The method of claim 6 wherein the gas generating fuel oxygenated nitrogen-containing organic compound is selected from the group consisting of guanidine nitrate, aminoguanidine nitrate, triaminoguanidine nitrate, nitroguanidine, nitrotriazalone and mixtures thereof.

8. The method of claim 1 wherein the gas generating fuel component comprises an organic compound with a high nitrogen content.

9. The method of claim 8 wherein the gas generating fuel organic compound with a high nitrogen content is selected from the group consisting of dicyandiamide, triazalone, tetrazoles, triazoles and mixtures thereof.

10. The method of claim 1 wherein the gas generating fuel component comprises a complex of at least one transition metal.

11. The method of claim 10 wherein the gas generating fuel transition metal complex is selected from the group consisting of transition metal complexes of tetrazoles and triazoles, transition metal nitrate complexes of nitrogen containing organic compounds and mixtures thereof.

12. The method of claim 1 wherein the precursor is formed to include the gas generating fuel component in an amount sufficient that the gas generating fuel comprises about 20 wt. % to about 70 wt. % of the transition metal diammine dinitrate-containing gas generant powder.

13. The method of claim 1 wherein the transition metal diammine dinitrate-containing gas generant powder comprises an oxidizer component constituting about 30 wt. % to about 60 wt. % of the formulation.

14. The method of claim 13 wherein the transition metal diammine dinitrate constitutes about 15 wt. % to about 100 wt. % of the oxidizer component.

15. The method of claim 14 wherein the precursor is formed to additionally include ammonium nitrate and wherein the oxidizer component additionally comprises ammonium nitrate.

16. The method of claim 1 wherein the precursor is formed to additionally include at least one performance additive and the transition metal diammine dinitrate-containing gas generant powder additionally includes the at least one performance additive.

17. The method of claim 16 wherein the at least one performance additive is selected from the group of aluminum oxide, silicon dioxide and combinations thereof.

18. The method of claim 1 wherein the precursor is formed to contain between about 30 wt. % and about 35 wt. % water.

19. A method of making a gas generant formulation which contains a gas generant fuel component and an oxidizer component comprising at least one transition metal diammine dinitrate selected from the group consisting of copper diammine dinitrate, zinc diammine dinitrate and combinations thereof, the method comprising the steps of:

combining an ammine carbonate of at least one transition metal elected from the group consisting of copper, zinc and mixtures thereof with nitric acid in the presence of water and in relative amounts to form a corresponding reaction mixture containing nitric acid in no more than a stoichiometric amount for reaction of the ammine carbonate and the nitric acid to form a corresponding diammine dinitrate;

forming a precursor to a spray dryable gas generant formulation, the precursor comprising the aqueous reaction mixture, additional gas generant formulation components including at least one gas generating fuel material and at least one performance additive selected from the group of aluminum oxide, silicon dioxide and combinations thereof, and a sufficient quantity of water to form a spray dryable gas generant formulation precursor slurry; and spray drying the gas generant formulation precursor slurry to form a gas generant powder; and heating the gas generant powder to a temperature in the range of about 125° C. to about 135° C. to form a gas generant formulation which contains a gas generant fuel component and an oxidizer component comprising a diammine dinitrate of the at least one transition metal.

20. The method of claim 19 wherein the at least one gas generating fuel material is selected from the group consisting of oxygenated nitrogen-containing organic compounds, organic compounds with a high nitrogen content, complexes of at least one transition metal and combinations thereof.

21. The method of claim 19 wherein the precursor is formed to include the gas generating fuel component in an amount sufficient that the gas generating fuel comprises about 20 wt. % to about 70 wt. % of the gas generant formulation.

22. The method of claim 19 wherein the gas generant formulation comprises an oxidizer component constituting about 30 wt. % to about 60 wt. % of the formulation.

23. The method of claim 22 wherein the transition metal diammine dinitrate constitutes about 15 wt. % to about 100 wt. % of the oxidizer component.

24. The method of claim 19 wherein the precursor is formed to additionally include ammonium nitrate and wherein the oxidizer component additionally comprises ammonium nitrate.

25. The method of claim 19 wherein the precursor is formed to contain between about 30 wt. % and about 35 wt. % water.

26. A method of making a gas generant formulation which contains a gas generant fuel component and an oxidizer component comprising at least one transition metal diammine dinitrate selected from the group consisting of copper diammine dinitrate, zinc diammine dinitrate and combinations thereof, the method comprising the steps of:

combining at least one ammine carbonate of a transition metal elected from the group consisting of copper, zinc and mixtures thereof with a quantity of nitric acid in the presence of water and in relative amounts to form a corresponding reaction mixture wherein no free nitric acid remains after reaction of the at least one ammine carbonate with the nitric acid;

forming a precursor to a spray dryable gas generant formulation, the precursor comprising the reaction mixture, additional gas generant formulation components including a sufficient amount of at least one gas generating fuel material selected from the group consisting of oxygenated nitrogen-containing organic compounds, organic compounds with a high nitrogen content, complexes of at least one transition metal and combinations thereof whereby about 20 wt. % to about 70 wt. % of the gas generant formulation constitutes such fuel material, at least one performance additive selected from the group of aluminum oxide, silicon dioxide and combinations thereof, and a sufficient quantity of water to form a spray dryable gas generant formulation precursor slurry containing between about 30 wt. % to about 35 wt. % water;

spray drying the gas generant formulation precursor slurry to form a gas generant powder; and heating the gas generant powder to a temperature in the range of about 125° C. to about 135° C. to form a heat treated gas generant powder comprising about 30 wt. % to about 60 wt. % of an oxidizer component, wherein the transition metal diammine dinitrate constitutes about 15 wt. % to about 100 wt. % of the oxidizer component.

27. The method of claim 26 wherein the oxidizer component additionally comprises ammonium nitrate and wherein the precursor is formed to include ammonium nitrate.

28. A method of making a phase stabilized ammonium nitrate, the method comprising:

drying and heat treating an aqueous slurry containing ammonium nitrate and a combination of at least one transition metal ammine carbonate and nitric acid, the nitric acid present in more than a stoichiometric amount relative to the at least one transition metal ammine carbonate for formation of the a corresponding transition metal diammine dinitrate, to form a phase stabilized ammonium nitrate.

29. The method of claim 28 wherein the drying comprises spray drying.

30. The method of claim 28 wherein the phase stabilized ammonium nitrate contains at least about 10 wt. % of a diammine dinitrate of the at least one transition metal.

31. The method of claim 30 wherein the phase stabilized ammonium nitrate contains at least about 15 wt. % of a diammine dinitrate of the at least one transition metal.

32. A phase stabilized ammonium nitrate made by drying and heat treating an aqueous slurry containing ammonium nitrate and a combination of at least one transition metal ammine carbonate and nitric acid, present in no more than a stoichiometric amount relative to the at least one transition metal ammine carbonate for formation of a corresponding transition metal diammine dinitrate, to form a phase stabilized ammonium nitrate.

* * * * *